United States Patent [19]

Klein

[11] 4,097,851

[45] Jun. 27, 1978

[54] SENSITIVITY COMPENSATED FIRE DETECTOR

[75] Inventor: Roy W. Klein, Hoffman Estates, Ill.

[73] Assignee: Pittway Corporation, Northbrook, Ill.

[21] Appl. No.: 706,685

[22] Filed: Jul. 19, 1976

[51] Int. Cl.[2] ..... G08B 17/10

[52] U.S. Cl. ..... 340/237 S; 250/381; 323/22 R; 307/297

[58] Field of Search ..... 340/237 S; 307/296, 307/297; 328/6; 323/19, 22 R, 22 S, 40, 17; 250/381, 385

[56] References Cited

U.S. PATENT DOCUMENTS

| | | | |
|---|---|---|---|
| 3,603,949 | 9/1971 | Walthard | 340/214 |
| 3,714,433 | 1/1973 | Kobayashi | 340/237 S X |
| 3,778,800 | 12/1973 | Blackwell et al. | 340/237 S X |
| 3,798,625 | 3/1974 | McMillian et al. | 340/237 S |
| 3,932,850 | 1/1976 | Conforti et al. | 340/237 S |
| 3,946,374 | 3/1976 | McMillian et al. | 340/237 S |

*Primary Examiner*—John W. Caldwell Sr.

*Assistant Examiner*—Daniel Myer

*Attorney, Agent, or Firm*—Gary, Juettner & Pyle

[57] ABSTRACT

A fire detector of the ionization type is characterized by sensitivity compensating circuitry. The detector includes an ionization chamber in series circuit with a reference impedance to form a voltage divider, and circuitry for sensing the voltage at the juncture between the ionization chamber and reference impedance and for generating a current flow which changes in value with changes in the voltage. The sensitivity compensating circuitry monitors the current flow, and for slowly occurring changes corresponding to slow changes in the juncture voltage adjusts the current flow to and maintains the flow at a quiescent value. The compensating circuitry responds relatively slowly to changes in current flow, and therefore does not significantly affect the current flow in response to a rapid change in juncture voltage. Thus, upon the occurrence of products of combustion within the ionization chamber, a relatively rapid change occurs in the juncture voltage to cause at least a predetermined change in the current flow, in response to which an alarm is generated.

17 Claims, 1 Drawing Figure

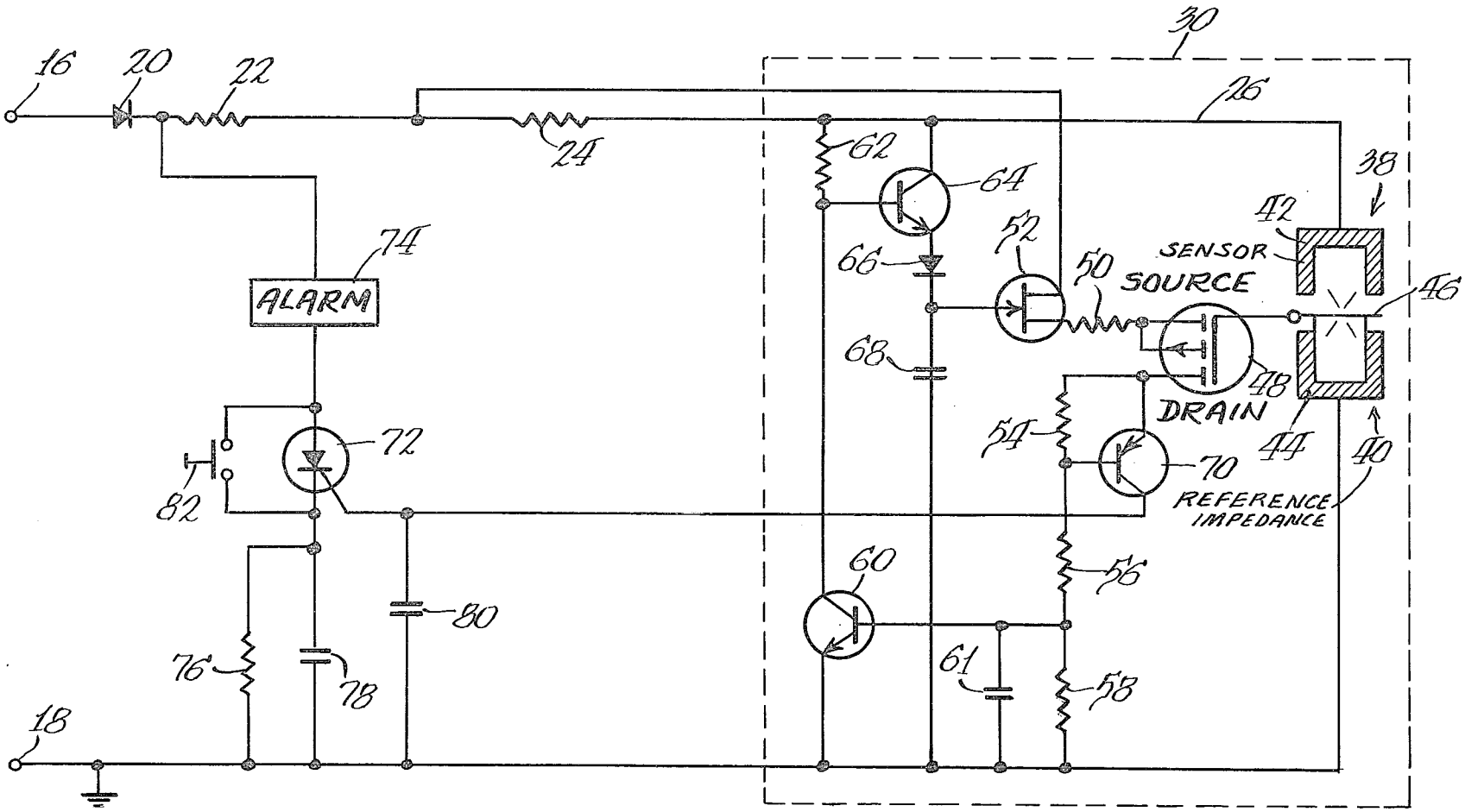
SENSOR
SOURCE
DRAIN
REFERENCE IMPEDANCE
ALARM

SENSITIVITY COMPENSATED FIRE DETECTOR

BACKGROUND OF THE INVENTION

The present invention relates to detectors having a sensor device for detecting a predetermined phenomenon, and in particular to a detector which is compensated against changes in sensitivity resulting from natural and slowly occurring ambient variations which affect the sensor.

Fire and smoke detectors employ a sensing device, such as a photocell or more commonly an ionization chamber, for detecting products of combustion. In an ionization chamber, a source of radiation ionizes air molecules between a pair of spaced electrodes, across which a voltage is applied to establish an electric field. The electric field moves the ionized molecules between the electrodes to provide a current flow. The space between the electrodes is open to the atmosphere, and upon the occurrence of fire products of combustion enter the chamber and combine with ionized air molecules to reduce the current flow and thereby increase the impedance of the chamber. This change in impedance occurs relatively rapidly and generates an electric signal which, through detecting circuitry, causes an alarm to be sounded.

A disadvantage of such detectors is that certain naturally occurring atmospheric conditions, such as changes in atmospheric pressure and relative humidity, accumulation of films of dirt and dust, etc., affect the magnitude of the current flow in the detecting chamber and may change the sensitivity of the detector, rendering the detector in many cases susceptible to generating spurious alarms. One way to minimize the occurrence of spurious alarms is to decrease the sensitivity of the detector to account for all reasonably anticipated variations in ambient conditions. Unfortunately, this technique also reduces sensitivity to products of combustion.

Naturally occurring changes in atmospheric conditions normally take place slowly, as compared with the rapid increase in concentrations of products of combustion upon the occurrence of fire. To compensate for these slowly occurring natural changes, without decreasing detector sensitivity to combustion, many detectors include a compensating or reference ionization chamber in series circuit with the detecting or sensor chamber to form a voltage divider. The compensating chamber is relatively closed to ambient, so as to have a relatively slow response to ambient variations. The detecting chamber on the other hand is open to the atmosphere for substantially immediate response to changing conditions. Circuitry detects the voltage at the junction of the divider or the balance of the voltage divider, and for slowly occurring changes in ambient conditions the reference or compensating chamber maintains the voltage divider in sufficient balance that an alarm signal is not generated. Should combustion occur, the active chamber responds far more rapidly than the reference chamber, the voltage divider becomes unbalanced to a predetermined magnitude, and the balance detecting circuitry generates an alarm signal.

Such detectors normally require an initial sensitivity adjustment of either or both the voltage divider or the voltage divider balance detecting circuitry so that the detector will generate an alarm in response to a predetermined rate of change in the concentration of products of combustion. Unfortunately, these adjustments are subject to change with aging of components and/or adverse atmospheric conditions (e.g. very high humidity). Furthermore, as the active chamber is considerably more open to the atmosphere than the reference chamber, changes may occur therein which do not normally affect the reference chamber (e.g. an accumulation of a film of dirt on the electrodes), which can change the sensitivity of the detector and/or increase the incidence of spurious alarms. For example, as dust accumulates within the active chamber the impedance thereof increases and the voltage divider becomes unbalanced toward an alarm condition. As a result, the detector becomes prone to generate a spurious alarm upon almost any variation in the ambient atmosphere, since the additional increase in impedance required to reach an alarm state has been decreased.

Conventionally, attempts to minimize false alarms occasioned by a slowly increasing impedance of the active or sensing chamber (or slowly decreasing impedance of the reference chamber) include the provision of circuitry for detecting two thresholds in the balance of the voltage divider, or two voltage thresholds at the junction between the active and reference chambers. One of the thresholds occurs when the balance of the voltage divider closely approaches an alarm condition, and the other upon the voltage divider reaching the alarm condition. A distinct alarm is generated for each threshold, a warning alarm for the first to indicate that a false alarm is likely, and a fire alarm for the second. Unfortunately, while such detectors warn of an impending false alarm from gradual changes affecting voltage divider balance, the sensitivities thereof nevertheless steadily increase as the first balance threshold is approached, which increases the probability of a false alarm from a spurious occurrence of aerosols, as might be caused by a cigarette smoke filled room. Further the detectors require periodic maintenance to eliminate or at least correct the cause of warning alarms, and with battery powered detectors failure to promptly correct the cause of a warning alarm may deplete the battery and result in failure of the detector to respond to combustion.

OBJECTS OF THE INVENTION

An object of the present invention is to provide improved sensitivity compensating circuitry for fire detectors and other similar phenomena detecting devices.

Another object of the present invention is to provide an improved detector of the voltage divider balance type, having circuitry which maintains the sensitivity of the detector essentially constant irrespective of slowly occurring changes in the balance of the voltage divider.

A further object of the invention is to provide a fire detector of the dual ionization chamber type, having a products of combustion detecting sensitivity which remains essentially constant despite slow changes in the impedance of either chamber.

Yet another object of the present invention is to provide a fire detector which automatically adjusts to a predetermined sensitivity to products of combustion, and then automatically maintains the predetermined sensitivity.

SUMMARY OF THE INVENTION

In accordance with the present invention, a detector having a sensor device responsive to the occurrence of predetermined phenomena includes circuitry for maintaining the sensitivity of the detector to the phenomena at a generally constant value.

In a preferred embodiment of the invention, the detector is a fire detector and the sensor is an ionization chamber responsive to products of combustion connected in a voltage divider circuit with a reference impedance. The balance of the voltage divider is detected, and a signal is generated which changes in value with changes in the balance of the voltage divider. For relatively slow changes in the balance of the voltage divider, the signal is adjusted to and maintained at a predetermined quiescent value independent of any of the parameters of the bridge. For relatively rapid changes in the balance of the chamber upon the presence of products of combustion, the signal is rapidly increased without significant compensation to a predetermined alarm value and a fire alarm is generated.

The invention thus provides a fire detector of generally constant sensitivity which is not susceptible to spurious alarms with slow changes in the balance of the voltage divider, as might occur with a gradual accumulation of dust within the ionization chamber, since to generate an alarm requires an additional imbalance of the voltage divider sufficient to change the signal from the quiescent to the alarm value.

The foregoing and other objects, advantages and features of the invention will become apparent from the following detailed description when taken in conjunction with the appended drawings.

BRIEF DESCRIPTION OF THE DRAWING

The single FIGURE is a schematic diagram of a fire detector employing sensitivity compensating circuitry according to the invention.

DETAILED DESCRIPTION

Referring to the drawing, a voltage (from a source not shown) is applied to a pair of terminals 16 and 18 and through a diode 20 and a pair of resistors 22 and 24 to a conductor 26 for supplying power to the sensitivity compensated fire detector circuit of the invention, shown generally at 30 within the dashed lines. The voltage supply may be a battery to provide a self-contained detector unit, or it may comprise any other suitable source, such as a transformer connected to a 120 volts ac line source and rectifier diodes to provide a nominal value dc voltage.

The products of combustion sensing circuit comprises a sensor device 38 connected in series with a reference impedance 40 between the conductor 26 and the terminal 18, and having an output at the junction of the sensor 38 and impedance 40 to form a voltage divider circuit. The sensor may comprise any suitable detecting device and the reference impedance may comprise any impedance suitable for use therewith. In the illustrated embodiment, the sensor device is an active or detecting ionization chamber which is open to ambient and the reference impedance is a reference or compensating ionization chamber which is relatively closed to ambient. The active chamber has an outer electrode 42 connected to the line 26, the reference chamber has an outer electrode 44 connected to the terminal 18, and the chambers share a common inner electrode 46. A source of alpha radiation disposed on opposite sides of the electrode 46 ionizes the air between the electrodes to provide a current flow therebetween, which generates at the electrode 46 a voltage having a value in accordance with the relative impedances of the chambers, or in accordance with the balance of the voltage divider circuit.

For slowly occurring natural changes in ambient conditions, such as changes in temperature, barometric pressure and relative humidity, the impedance of the reference chamber changes in the same direction and by substantially the same amount as that of the active chamber, so that the voltage divider remains balanced. Upon the occurrence of combustion, however, products of combustion enter the active chamber much more readily than the reference chamber, and being of greater mass than air molecules cause a reduction in the amount of ion current flowing between the electrodes of the active chamber. Consequently, the impedance of the active chamber is increased upon the presence in the air of products of combustion, and the balance of the voltage divider is changed by at least a predetermined magnitude.

Circuitry for detecting the balance of the voltage divider includes a voltage divider balance detecting field-effect transistor (FET) 48, the gate of which is connected to the common electrode 46 at the center of the voltage divider for sensing the voltage thereat, whereby the voltage controls the impedance or conductivity between the source and drain terminals of the FET. The source of the FET 48 is connected through a resistor 50 and a junction FET 52 to the juncture of the resistors 22 and 24, and the drain of the FET is connected through resistors 54, 56 and 58 to the terminal 18. The junction FET 52 operates, as will be described, as a voltage source for the source of the voltage divider balance detecting FET 48.

A transistor 60, for sensing or monitoring the current through the FET 48, is connected at its base to the juncture between the resistors 56 and 58 and to a filter capacitor 61, with its emitter-collector in series with a resistor 62 between the conductor 26 and the terminal 18. A transistor 64, for controlling the voltage applied to the gate of the FET 52, is connected at its base to the juncture between the resistor 62 and the collector of the transistor 60, with its emitter-collector in series with a diode 66 and a capacitor 68 between the conductor 26 and the terminal 18. The gate of the FET 52 is connected to the juncture between the diode 66 and the capacitor 68, whereby the conductivity of the FET is controlled by the voltage across the capacitor 68.

Under steady ambient conditions the voltage at the gate of the FET 48, and therefore the impedance thereof, is constant, and the current flow therethrough is maintained at a quiescent value such as, by way of example and depending upon the specific parameters of the circuit components, 10ua. The manner in which the current flow is maintained at the quiescent value may best be understood by first considering the condition where less than 10ua flows through the FET 48. This current also flows through the resistor 58, the value of which is selected to maintain the transistor 60 nonconductive when the current is less than 10ua. With the transistor 60 nonconductive, the transistor 64 is biased into conduction through the resistor 62 to change the capacitor 68 through the diode 66 to increase the voltage at the gate of the FET 52. This decreases the impedance of the FET to increase the voltage at the source of the FET 48, whereby the FET 48 conducts greater current. When the current through the FET reaches 10ua, the voltage drop across the resistor 58 biases the transistor 60 into conduction to turn off the transistor 64 and stop charging of the capacitor 68. This prevents a further increase in the voltage at the gate of the FET 52 to limit the current flow through the FET 48 to the quiescent value. The voltage at the gate of the FET 52 then slowly decreases as the capacitor 68 very slowly self-discharges as a result of its inherent leakage, which decreases the voltage at the source of the FET 48 and therefore the current therethrough. As the current attempts to decrease below the quiescent value, the voltage drop across the resistor 58 decreases the conductivity of the transistor 60, whereupon the afore-described cycle of operation is repeated. This maintains the current flow at essentially the quiescent value.

For the condition where more than 10ua initially flows through the FET 48, the transistor 60 remains conductive until the capacitor 68 sufficiently discharges to reduce the current through the FET to the quiescent value, whereupon the circuit operates as described. Thus, for any steady voltage at the gate of the FET 48, the current flow therethrough is brought to and maintained at the quiescent value. For changing values of voltage at its gate, the current follows the voltage, but is simultaneously adjusted toward the quiescent value.

In use of the detector, the circuitry maintains the sensitivity of the detecting circuit essentially constant despite gradual changes in the balance of the voltage divider resulting from changes affecting only one of the chambers. For example, assume that the impedance of the active chamber gradually changes, perhaps from a gradual accumulation of dust therein, without a corresponding change in the impedance of the reference chamber. The voltage sensed at the gate of the FET 48 follows the change in balance of the voltage divider. The current through the FET, however, is maintained at essentially the quiescent value for slow changes in its gate voltage, and therefor for slow changes in the balance of the voltage divider. The sensitivity of the detector to products of combustion is thus maintained essentially constant independent of and without affecting any of the parameters of the bridge, such as the impedance thereof or the magnitude of the current flow therethrough or the voltage thereacross, whereby the sensitivity of the bridge itself to products of combustion remains substantially constant to ensure proper operation of the detector in response to predetermined concentrations of products of combustion.

In the event of combustion, products of combustion readily enter the active chamber, but not the relatively closed reference chamber, in sufficient concentrations to significantly increase the impedance of the chamber and relatively rapidly unbalance the voltage divider. As a result, the voltage at the gate of the FET 48 increases the current therethrough substantially faster than discharge of the capacitor 68 decreases the current, and when the current reaches a predetermined alarm value a fire alarm signal is generated.

Thus the particular state of balance of the voltage divider, whether constant or slowly changing, has no effect on the sensitivity of the detector to products of combustion, since to generate an alarm always requires products of combustion in sufficient concentrations and at a sufficiently rapid rate of change in concentration to unbalance the voltage divider by yet an additional amount adequate to change the current flow through the voltage divider balance detecting circuit from the quiescent value to a predetermined alarm value. In other words, the circuitry uses the immediate state of voltage divider balance as a reference point, and requires a predetermined additional change in balance in order for an alarm signal to be generated.

In the illustrated circuit, the predetermined alarm value current is sensed by a transistor 70 connected at its base to the juncture of the resistors 54 and 56, and at its emitter to the drain of the FET 48. The value of the resistor 54 is selected so that when the current through the FET 48 reaches the predetermined alarm value, the transistor 70 is rendered conductive to generate an alarm signal at its collector.

Circuitry which may be used with the detector 30 of the invention for sounding an alarm includes, by way of example, an SCR 72 connected at its gate to the collector of the transistor 70 so as to be rendered conductive when the transistor 70 is conductive. The SCR is connected at its anode to the juncture of diode 20 and resistor 24 through an alarm device 74, such as an audible horn, and at its cathode to the conductor 28 through a resistor 76 in parallel with a filter capacitor 78. When the current through the FET 48 reaches the predetermined alarm value, the transistor 70 becomes conductive and fires the SCR 72 to energize the horn or other alarm device. Once fired, the SCR remains conductive until reset. For the purpose where the system is ac powered, a capacitor 80 is connected between the gate of the SCR and the conductor 28 to hold the SCR on until both the current through the FET 48 becomes less than the predetermined alarm value and the SCR is reset by closure of a manually operated by-pass switch 82. The switch 82 is also operable to manually test the alarm device 74.

The invention thus provides an improved detector which is sensitivity compensated to reduce the probability of false alarms, and to minimize maintenance. Since for constant or slowly changing conditions of voltage divider balance the current through the balance detecting circuit is maintained at a quiescent value, an alarm signal can be generated only upon a sufficiently rapid rate of increase in the presence of products of combustion in sufficient concentrations to change the balance of the voltage divider by an additional amount which fully changes the current from the quiescent value to the predetermined alarm value. As a consequence, changes affecting the impedance of only one of the chambers neither increase nor decrease the sensitivity of the detector and the detector requires minimum maintenance, such as periodic cleaning of the chambers. This significantly differs from known detectors which are preadjusted to generate an alarm when a predetermined condition of voltage divider balance is reached, and which either increase or decrease in sensitivity with natural changes in voltage divider balance away from or toward the predetermined, alarm generating balance. Also, since the detector automatically adjusts to the quiescent value of current flow as determined by the value of the resistor 58, and since the alarm value current is determined by the value of the resistor 54, the sensitivity of the detector may be readily determined by appropriate selection of the values of the resistors 54 and 58, and no initial factory preadjustment of the detector is required.

While one particular embodiment of the invention has been described in detail, various modifications and other embodiments thereof may be devised by one skilled in the art without departing from the spirit and the scope of the invention, as defined by the appended claims.

What is claimed is:

1. In a detecting device, a detector circuit having terminals for receiving a voltage thereacross and an impedance between said terminals which changes in value in accordance with the presence or absence of predetermined phenomena, for providing a first electric signal which changes relatively rapidly in value in response to the occurrence of said phenomena, means for generating in response to said first signal a second electric signal which changes in value in response to changes in value of said first signal, and means for monitoring the value of said second signal and for controlling said generating means to maintain said second signal at substantially a first predetermined value independent of said voltage across and impedance of said detector means for constant and relatively slowly changing values of said first signal, said second signal having at least a second predetermined value upon the occurrence of said phenomena.

2. In a detecting device as in claim 1, including means for generating an alarm signal upon said second signal attaining said second predetermined value.

3. In a detecting device as set forth in claim 1, said means for generating said second signal including means for generating a current flow which changes in value in response to changes in value of said first signal, said means for monitoring the value of said second signal and for controlling said generating means maintaining said current flow at substantially said first predetermined value for constant and relatively slowly changing values of said first signal, said generating means providing a current flow having said second predetermined value upon the occurrence of said predetermined phenomena.

4. In a detecting device as set forth in claim 3, said means for generating said current flow including a field-effect transistor (FET) having drain, source and gate electrodes, means for applying a voltage across said drain and source electrodes, and means for applying said first signal to said gate electrode for controlling the conductivity of said FET between said drain and source electrodes, said FET generating said current flow through said drain and source electrodes.

5. In a detecting device as set forth in claim 4, said means for monitoring said current flow and for controlling said generating means including means responsive to the value of said current flow for controlling the value of said voltage applied across said drain and source electrodes to maintain said current flow at substantially said first predetermined value for constant and relatively slowly changing values of said first signal at said gate.

6. In a detecting device as set forth in claim 4, said means for monitoring said current flow and for controlling said generating means including a resistor in series circuit with said drain and source electrodes for having said current flow therethrough, a semiconductor device having a control electrode and a pair of controlled electrodes connected with said controlled electrodes in series circuit with said drain and source electrodes of said FET, and means for sensing the voltage across said resistor and for generating at said control electrode a voltage which increases the impedance between said controlled electrodes when said current flow is in excess of said first predetermined value and decrease the impedance between said controlled electrodes when said current flow is less than said predetermined value.

7. In a fire detector having a sensor device, which exhibits a change in impedance upon the presence of products of combustion, connected in a series circuit with a reference impedance to form a voltage divider circuit, means for applying a voltage across said voltage divider, means for monitoring the voltage at the juncture of said sensor device and reference impedance and for generating a signal which changes in value with changes in the value of said juncture voltage, and means for sensing the value of said signal and for adjusting said monitoring and generating means for maintaining said signal at a substantially constant quiescent value independent of said voltage across and said impedance of said voltage divider circuit and irrespective of relatively slow changes in the value of said juncture voltage, said monitoring and generating means, in response to a relatively rapid predetermined amount of change in the value of said juncture voltage, generating a signal of a predetermined alarm value at a rate more rapid than the rate of response of said sensing and adjusting means, whereby the sensitivity of said detector to products of combustion is relatively constant since generating said signal of predetermined alarm value requires said sensor device to sense a sufficiently rapid change in products of combustion in sufficient concentrations to change said juncture voltage by said predetermined amount.

8. In a fire detector, a pair of terminals for connecting with a source of voltage; a voltage divider circuit connected with said terminals and including a reference impedance connected in series with a sensing device responsive to products of combustion, said sensing device having an impedance in accordance with the presence or absence of products of combustion; means in circuit with said terminals for monitoring the voltage at the juncture of said reference impedance and said sensing device and for generating an electric signal which changes in value in response to changes in the value of said juncture voltage; means in circuit with said terminals for sensing the value of said signal and for relatively slowly adjusting said monitoring and generating means for maintaining said signal at a substantially constant quiescent value independent of the value of said source of voltage and the impedance of said voltage divider and despite relatively slowly occurring changes in said juncture voltage; said monitoring and generating means relatively rapidly changing the value of said signal to a predetermined alarm value in response to a relatively rapid predetermined amount of change in the value of said juncture voltage, the rate of change in the value of the signal being more rapid than the rate of response of said sensing and adjusting means; and means connected in circuit with said terminals and said monitoring and generating means for transmitting an alarm signal upon said electric signal attaining said predetermined alarm value.

9. In a fire detector as set forth in claim 8, said electric signal being an electric current flow, said monitoring and generating means including a first field-effect transistor (FET) having drain, source and gate electrodes, connected at said gate electrode with said juncture voltage for sensing the value thereof, and connected with said drain and source electrodes in circuit with said terminals for generating said current flow through said electrodes, the value of said juncture voltage controlling the conductivity of said FET between said drain and source electrodes.

10. In a fire detector as set forth in claim 9, said sensing and adjusting means including means responsive to the value of said current flow through said FET for controlling the voltage across said drain and source terminals of said FET to adjust the current flow therethrough to said quiescent value.

11. In a fire detector as set forth in claim 9, said sensing and adjusting means including a first resistor in series circuit with said drain and source electrodes of said FET for having said current flow therethrough; a second field-effect transistor (FET) having drain, source and gate electrodes, connected with said drain and source electrodes in series circuit with said drain and source electrodes of said first FET, and means responsive to the voltage across said first resistor for applying a control voltage to the gate electrode of said second FET to control the conductivity between the drain and source electrodes thereof and to thereby control the voltage across said drain and source electrodes of said first FET.

12. In a fire detector as set forth in claim 11, said means responsive to the voltage across said first resistor for applying a control voltage to said gate electrode of said second FET including a capacitor connected in circuit between said gate electrode of said second FET and one of said terminals, said capacitor relatively slowly self-discharging through leakage a voltage applied thereacross, and semiconductor means, connected with said first resistor and said capacitor, responsive to the voltage across said resistor to charge said capacitor to apply said control voltage to said gate electrode of said second FET.

13. In a fire detector, a pair of terminals for connecting with a source of voltage; a voltage divider circuit connected with said terminals and including a reference impedance connected in series with a sensing device responsive to products of combustion, said sensing device having an impedance in accordance with the presence or absence of products of combustion; means in circuit with said terminals for monitoring the voltage at the juncture of said reference impedance and said sensing device and for generating an electric signal which changes in value in response to changes in the value of said juncture voltage; means in circuit with said terminals for sensing the value of said signal and for relatively slowly adjusting said monitoring and generating means for maintaining said signal at a substantially constant quiescent value independent of the value of said source of voltage and the impedance of said voltage divider and despite relatively slowly occurring changes in said juncture voltage; said monitoring and generating means relatively rapidly changing the value of said signal to a predetermined alarm value in response to a relatively rapid predetermined amount of change in the value of said juncture voltage, the rate of change in the value of the signal being more rapid than the rate of response of said sensing and adjusting means; and means connected in circuit with said terminals and said monitoring and generating means for transmitting an alarm signal upon said electric signal attaining said predetermined alarm value, said electric signal being an electric current flow, said monitoring and generating means including a first field-effect transistor (FET) having drain, source and gate electrodes, connected at said gate electrode with said juncture voltage for sensing the value thereof, and connected with said drain and source electrodes in circuit with said terminals for generating said current flow through said electrodes, the value of said juncture voltage controlling the conductivity of said FET between said drain and source electrodes, said sensing and adjusting means including a first resistor in series circuit with said drain and source electrodes of said FET for having said current flow therethrough; a second field-effect transistor (FET) having drain, source and gate electrodes, connected with said drain and source electrodes in series circuit with said drain and source electrodes of said first FET, and means responsive to the voltage across said first resistor for applying a control voltage to the gate electrode of said second FET to control the conductivity between the drain and source electrodes thereof and to thereby control the voltage across said drain and source electrodes of said first FET. Said means responsive to the voltage across said first resistor for applying a control voltage to said gate electrode of said second FET including a capacitor connected to circuit between said gate electrode of said second FET and one of said terminals, said capacitor relatively slowly self-discharging through leakage a voltage applied thereacross. And semiconductor means, connected with said first resistor and said capacitor, responsive to the voltage across said resistor to charge said capacitor to apply said control voltage to said gate electrode of said second FET, said semiconductor means including a first transistor; a diode connected between said gate of said second FET and the collector-emitter circuit of said transistor for being forward biased to charge said capacitor to change said control voltage at the gate of said second FET when said transistor is rendered conductive, and a second transistor connected at its base with the first resistor for having its conductivity controlled by the voltage thereacross and therefore by said current flow therethrough, and connected through its collector-emitter circuit with the base of said first transistor to control the conductivity thereof such that said first transistor is nonconductive when said second transistor is conductive, and vice versa, said second transistor controlling the conductivity of said first transistor in response to said voltage across said first resistor to apply said control voltage to said gate of said second FET.

14. In a fire detector as set forth in claim 13, said means for transmitting said alarm signal upon said current flow having said predetermined value including a second resistor in series circuit with said drain and source of said first FET, and third transistor connected with said second resistor for having its conductivity controlled by the voltage thereacross, the voltage across said second resistor rendering said third transistor conductive to transmit said alarm signal upon said current flow reaching said predetermined value.

15. In a fire detector as set forth in claim 8, said sensing device being an ionization chamber.

16. In a method of detecting the presence of a predetermined condition in a gaseous atmosphere; the steps of introducing said gaseous atmosphere into sensing means connected in a voltage divider circuit with a reference impedance, said sensing means exhibiting an impedance in accordance with the presence or absence of said predetermined condition; applying a voltage across said voltage divider circuit; monitoring the value of the voltage at the juncture of said sensing means and said reference impedance and generating a signal which changes in value with changes in the value of said juncture voltage; adjusting independent of said voltage across and said impedance of said voltage divider said signal to a substantially constant quiescent value for constant and relatively slowly changing values of said juncture voltage; introducing into said sensing means said gaseous atmosphere having said predetermined condition at a sufficiently rapid rate and in sufficient concentrations to relatively rapidly change the value of said juncture voltage and to generate a signal having a predetermined value at a rate more rapid than the rate at which said signal is adjusted to said quiescent value, and indicating that said signal has said predetermined value.

17. In a method of detecting the presence of smoke and combustion aerosols in a gaseous atmosphere, the steps of introducing said gaseous atmosphere into an ionization chamber connected in a voltage divider circuit with a reference impedence, applying a voltage across said voltage divider circuit; monitoring the value of the voltage at the juncture of said ionization chamber and reference impedance and generating a signal which changes in value with changes in the value of said juncture voltage; sensing the value of said signal and adjusting independent of said voltage across and said impedance of said voltage divider said signal to a substantially constant quiescent value, for constant and relatively slowly changing values of said juncture voltage; introducing said aerosols into said chamber at a sufficiently rapid rate and in sufficient concentrations to relatively rapidly change the value of said juncture voltage and to generate a signal having a predetermined value at a rate more rapid than the rate at which said signal is adjusted to said quiescent value, and indicating that said signal has said predetermined value.

* * * * *